US008491423B1

(12) United States Patent
Biggio et al.

(10) Patent No.: US 8,491,423 B1
(45) Date of Patent: Jul. 23, 2013

(54) TRAINING AID FOR A BATTER

(75) Inventors: Craig Alan Biggio, Houston, TX (US); Matthew Paul Hicks, Houston, TX (US); Blaine Stephen LaFleur, Sunset, LA (US); Paul Buckley Hicks, Houston, TX (US)

(73) Assignee: Training Bat, LLC, Houston, TX (US)

( * ) Notice: Subject to any disclaimer, the term of this patent is extended or adjusted under 35 U.S.C. 154(b) by 105 days.

(21) Appl. No.: 13/269,855

(22) Filed: Oct. 10, 2011

Related U.S. Application Data

(60) Provisional application No. 61/391,298, filed on Oct. 8, 2010.

(51) Int. Cl.
*A63B 69/00* (2006.01)

(52) U.S. Cl.
USPC ..... 473/457; 473/422

(58) Field of Classification Search
USPC . 473/457, 422, 431, 520, 538, 564; D21/725, D21/780
See application file for complete search history.

(56) References Cited

U.S. PATENT DOCUMENTS

| | | | | | |
|---|---|---|---|---|---|
| 537,927 | A * | 4/1895 | Kennedy | ..... | 473/520 |
| 546,540 | A * | 9/1895 | Kennedy | ..... | 473/520 |
| 1,509,733 | A * | 9/1924 | Langford | ..... | 473/520 |
| 3,679,205 | A * | 7/1972 | Finkle et al. | ..... | 473/463 |
| 4,399,996 | A * | 8/1983 | Boyce | ..... | 473/457 |
| 4,555,111 | A * | 11/1985 | Alvarez | ..... | 473/457 |
| 5,516,097 | A * | 5/1996 | Huddleston | ..... | 473/457 |
| 6,485,381 | B1 * | 11/2002 | Pai | ..... | 473/521 |
| 6,569,042 | B2 * | 5/2003 | LaChance et al. | ..... | 473/457 |
| 6,625,848 | B1 * | 9/2003 | Schneider | ..... | 473/520 |
| 7,201,679 | B2 * | 4/2007 | Nguyen | ..... | 473/520 |
| 7,235,024 | B2 * | 6/2007 | Lefebvre et al. | ..... | 473/457 |
| 7,297,077 | B1 * | 11/2007 | Battaglino | ..... | 473/457 |
| 2004/0162167 | A1 * | 8/2004 | Stevens et al. | ..... | 473/457 |

* cited by examiner

*Primary Examiner* — Mitra Aryanpour
(74) *Attorney, Agent, or Firm* — Buskop Law Group, PC; Wendy Buskop

(57) ABSTRACT

A training aid for a batter, which can include a barrel, a handle, and a connection assembly, wherein the connection assembly can be configured to allow the barrel to pivot to form an angle of one hundred eighty degrees between the barrel and the handle when a batter uses proper swing mechanics. The connection assembly can be configured to allow the barrel to pivot to form an angle different than one hundred eighty degrees between the barrel and the handle when a batter swings with improper swing mechanics, such as a "flying lead elbow", "casting", a "wrap swing", a "hitch", or "barring out".

9 Claims, 2 Drawing Sheets

TRAINING AID FOR A BATTER

The present application claims priority to and the benefit of U.S. Provisional Patent Application Ser. No. 61/391,298 filed on Oct. 8, 2010, entitled "TRAINING AID FOR A BATTER". This reference is hereby incorporated in its entirety.

FIELD

The present embodiments generally relate to a training aid for a batter for immediate feedback when a batter improperly swings a bat.

BACKGROUND

A need exists for a training aid to immediately inform a batter when a "flying lead elbow" swing is used.

A need exists for a training aid to instantly notify a batter when a "wrap" swing is being used.

A need exists for a training aid to give immediate feedback when a batter uses a swing movement known as "casting".

A need exists for a training aid to immediately give feedback when a batter uses a swing motion containing a "hitch".

A further need exists for a training aid to immediately give feedback when a batter is "barring out".

The present embodiments meet these needs.

BRIEF DESCRIPTION OF THE DRAWINGS

The detailed description will be better understood in conjunction with the accompanying drawings as follows.

Figures 1, 1A:
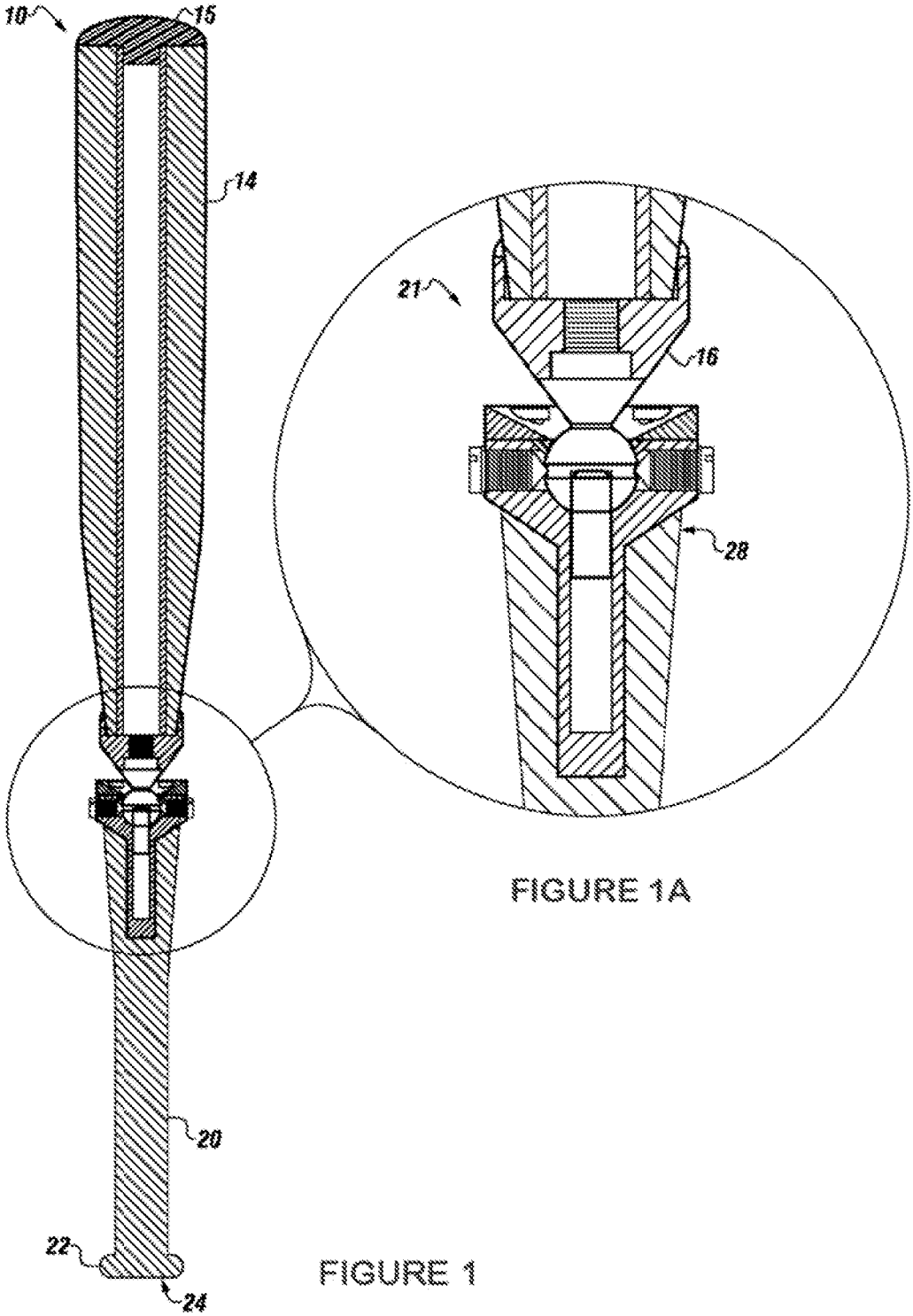
FIG. 1 depicts an illustrative embodiment of the training aid for a batter.
FIG. 1A depicts an enlarged view of the connection assembly.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a training aid for a batter.

One or more embodiments of the training aid for a batter can include a barrel, a handle, and a connection assembly.

The barrel can have a top end and a tapered bottom end. The tapered bottom end can be disposed on the barrel opposite the top end. The tapered bottom end can be a casing or an apparatus connected to the barrel, formed on the barrel, or otherwise disposed on the barrel. A threaded hole can be formed through at least a portion of the tapered bottom end. The threaded hole can be centrally located on the tapered bottom end.

The handle can have a first end and a second end. The first end can have a knob disposed thereon. For example, the knob can be formed on the first end or otherwise connected to the first end.

The connecting assembly can include a housing, a first half split flange, a second half split flange, a pivoting connector, and a pin.

The housing can be connected to the second end of the handle. The housing can have a top surface. An inner chamber can be disposed through the top surface. A central fastening chamber can be disposed adjacent to the inner chamber. In one or more embodiments, the central fastening chamber can be threaded. The inner chamber can have a plurality of inner engagement holes. Each inner engagement hole can be adapted to receive a pointed fastener. The pointed fastener can have a pointed end.

The top surface can have a plurality of top engagement holes. Each top engagement hole can be adapted to receive a flat faced fastener.

The first half split flange can have one or more first half engagement holes. The second half split flange can include one or more second half engagement holes. The first half split flange and the second half split flange can form a tapered surface when placed adjacent to one another. The first half split flange and the second half split flange can be positionable over the top surface. The first half engagement holes and second half engagement holes can be aligned with the top engagement holes.

The pivoting connector can have a ball, a conical skirt, and a threaded extension. The pivoting connector can be made from steel or a reinforced metal. The ball can have a pin hole centrally disposed therein. An outer groove can be disposed around a perimeter of the ball. The outer groove can be configured to engage one or more pointed fasteners. For example, the outer groove can receive and accept the pointed ends of the pointed fasteners.

The conical skirt can be connected to the ball. For example, a top portion of the conical skirt can be connected to the ball opposite the pin hole. The threaded extension can have an outer diameter less than an outer diameter of the conical skirt. The threaded extension can centrally extend from the conical skirt. For example, the threaded extension can extend away from a bottom portion of the conical skirt.

The threaded extension can engage the threaded hole formed into the bottom tapered end of the barrel. Accordingly, the pivoting connector can rotate freely between the first half split flange and the second half split flange.

The pin can engage the pin hole and the central fastening chamber. For example, the pin can slidingly engage the pin hole and the central fastening chamber simultaneously.

The connection assembly can be configured to maintain an angle of one hundred eighty degrees between the barrel and the handle when a batter uses proper swing mechanics. The connection assembly can be configured to allow an angle different than one hundred eighty degrees between the barrel and handle when the batter does not use proper swing mechanics. The connection assembly can be configured to pivot the barrel to provide an angle different than one hundred eighty between the barrel and the handle when the batter does not use proper swing mechanics. For example, the connection assembly can be configured to allow the barrel to pivot to form an angle different than one hundred eighty degrees between the barrel and the handle when a batter has a "flying lead elbow" swing. A "flying lead elbow" swing is when a batter's elbow extends away from the body of the batter between the start and finish of the batter's swing.

In another example, the connection assembly can be configured to allow the barrel to pivot to form an angle different than one hundred eighty degrees between the barrel and the handle when the batter has a "wrap" swing. A "wrap" swing is when at least a portion of the barrel positions behind the batter's head during the batter's swing.

In another example, the connection assembly can be configured to allow the barrel to pivot to form an angle different than one hundred eighty degrees between the barrel and the handle when the batter uses a swing movement known as "casting". "Casting" is when the knob is moved towards a batter's body and the barrel is moved away from the batter's body during the batter's swing.

In another example, the connection assembly can be configured to allow the barrel to pivot to form an angle different than one hundred eighty degrees between the barrel and the handle when the batter uses a swing movement known as a "hitch". A "hitch" swing is when the handle is dropped from an initial swing location to a second swing location and the barrel is moved away from the batter's body during the batter's swing.

In another example, the connection assembly can be configured to allow the barrel to pivot to form an angle different than one hundred eighty degrees between the barrel and the handle when the batter uses a swing movement known as "barring out". "Barring out" is when the batter moves the bat away from his body and behind him before moving the bat forward towards a ball during the batter's swing.

In one or more embodiments, the barrel, the handle, the knob, the housing, and tapered bottom end can be made from a non-deforming lightweight polymer, aluminum, a graphite composite polymer, or combinations thereof.

In one or more embodiments, the connection assembly can have an outer housing disposed about it. The outer housing can be a flexible material, such as natural rubber; plastic; cloth; synthetic rubbers, such as polychloroprene; or combinations thereof.

The training aid for a batter can teach a batter to position the bat in the "hitting zone" as quickly as possible. This allows the batter a better chance to hit against pitcher's that throw hard, and also allows the hitter more time to identify what type of pitch is being thrown before committing to a particular swing.

The training aid for a batter can give the batter instant feedback if the batter is swinging the bat incorrectly.

The training aid for a batter can help a batter keep the bat level as it approaches the "hitting zone", thereby increasing the batter's odds of successfully hitting hard hit line drives rather than poorly hitting pop-ups or ground balls. This can be accomplished by helping a batter realize when the bat is on a proper plane while the batter is approaching the "hitting zone". For example, if the bat is not on a proper plane while approaching the "hitting zone", the training aid for a batter can form an angle different than one hundred eighty degrees between the barrel and the handle, thereby indicating to the batter that the bat is not on a proper plane.

The training aid for a batter can allow the batter to use "muscle memory" during their training sessions. In other words, the training aid for a batter can allow the batter to "memorize" a proper swing through repetition.

The training aid for a batter can reduce the need for a batter to receive private instruction; thereby, reducing the costs associated with making a batter a more successful hitter.

For example, Tom can be having trouble hitting a baseball. To correct his trouble with hitting the baseball, Tom can use the training aid for a batter. Tom can use the training aid for a batter by taking his normal batting stance and swinging the training aid for a batter. The training aid for a batter can provide Tom with an instant feedback indication that he is casting, barring-out, wrapping, has a hitch in his swing, is swinging with a flying lead elbow, or not swinging on the proper plane, because the training aid for a batter will collapse to form an angle different than one hundred eighty degrees between the barrel and the handle, giving Tom instant feedback.

Once Tom, or any batter, is able to constantly swing the training aid for a batter without the training aid for a batter collapsing, the training aid for a batter can help the batter develop a swing that is on plane and level at the "hitting zone" and that is quick to the "hitting zone".

As such, Tom can identify a proper swing almost instantly and can practice with the training aid for a batter until he builds "muscle memory" that will enable him to consistently use proper swing mechanics during a game.

Turning now to the Figures, FIG. 1 depicts an isometric view of an illustrative training aid 10 for a batter. The training aid 10 for a batter can include a barrel 14, a handle 20, and a connection assembly 21.

The barrel 14, which can be substantially similar to a barrel of a bat used for softball, baseball, or the like, can have a top end 15 opposite a tapered bottom end 16. The tapered bottom end 16 can be formed on the barrel 14 or can be disposed on the barrel 14. For example, the tapered bottom end 16 can be welded, bolted or otherwise connected to the barrel 14, or the tapered bottom end 16 can be formed on the barrel 14 as the barrel is formed, for example, by machining, casting, forging, or molding.

The handle 20 can have a knob 22 secured to a first end 24 thereof. The handle 20 can be substantially similar to a handle used on a baseball bat, softball bat, or the like. The handle 20 can also have a second end 28 connected to at least a portion of the connection assembly 21.

Figure 2:
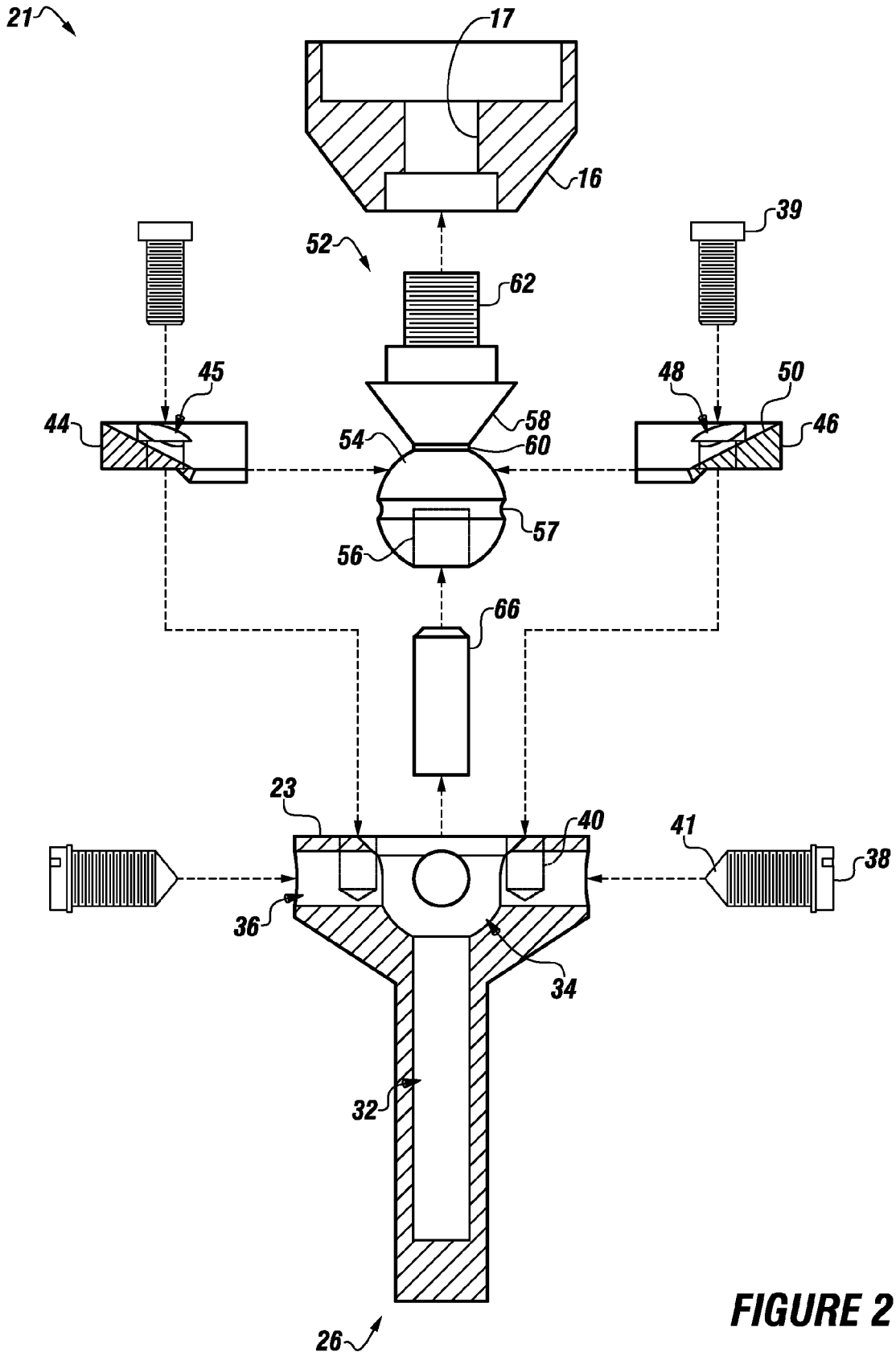
FIG. 2 depicts an exploded view of a connection assembly and tapered bottom end of the illustrative embodiment of the training aid for a batter depicted in FIG. 1.

FIG. 2 depicts an exploded view of the illustrative connection assembly 21 and the illustrative tapered bottom end 16.

The tapered bottom end 16 can include one or more threaded holes 17. The threaded hole 17 can be formed into the tapered bottom end 16 or otherwise disposed on or through a portion of the tapered bottom end 16.

The connection assembly 21 can include a housing 26, a first half split flange 44, a second half split flange 46, a pivoting connector 52, and a pin 66.

The housing 26 can include a top surface 23. The top surface 23 can have a plurality of top engagement holes, such as top engagement hole 40. For example, the top surface 23 can include from about one to about twelve top engagement holes.

An inner chamber 34 can be formed through or disposed within the top surface 23. The inner chamber 34 can be disposed within the housing 26. For example, the inner chamber 34 can be disposed in the housing 26 adjacent to a central fastening chamber 32 in the housing 26.

The inner chamber 34 can include a plurality of inner engagement holes 36. For example, the inner chamber 34 can include from about one to about twelve inner engagement holes.

The first half split flange 44 can have one or more first half engagement holes 45. For example, the first half split flange 44 can have from about one to about twelve first half engagement holes.

The second half split flange 46 can have one or more second half engagement holes 48. For example, the second half split flange 46 can have from about one to about twelve second half engagement holes 48.

The pivoting connector 52 can include a ball 54, a conical skirt 58, and a threaded extension 62.

The ball 54 can have a pin hole 56 and an outer groove 57 formed about a perimeter thereof. The pin hole 56 can be formed through a portion of the ball 54 and can be centrally located on a portion of the ball 54.

The conical skirt 58 can have a top portion 60 connected to a portion of the ball 54. For example, the top portion 60 can be connected to the ball 54 on a portion opposite the pin hole 56.

The threaded extension 62 can extend from the conical skirt 58 opposite the top portion 60. The threaded extension 62 can have an outer diameter that is less than an outer diameter of the conical skirt 58. The threaded extension 62 can be centered on the conical skirt 58.

The pin 66 can be any connection device. For example, the pin 66 can be a dowel, a rod having one or more tapered portions, a cylindrical rod, a hollow rod, a solid rod, or the like.

The connection assembly 21 can be used to connect the barrel 14 of FIG. 1 and the handle 20 of FIG. 1 to one another. In operation, the housing 26 can secure to the second end 28 of the handle 20 of FIG. 1. For example, at least portion of the housing 26 can be welded, threaded, bolted, or otherwise connected to the handle 20 of FIG. 1. In another embodiments, at least a portion of the housing 26 can be formed on the handle 20 of FIG. 1 during manufacturing. For example, at least a portion of the housing 26 can be formed as the handle 20 of FIG. 1 is machined or casted, forged, or molded.

The first half split flange 44 and the second half split flange 46 can be configured to form a tapered surface 50 when placed adjacent to one another. As such, the first half split flange 44 and the second half split flange 46 can be placed adjacent to one another about the conical skirt 58. The tapered surface 50 can be adjacent to the top portion 60.

In addition, the first half split flange 44 and the second half split flange 46 can be positioned adjacent to the top surface 23. The first half engagement holes 45 and the second half engagement holes 48 can be aligned with top engagement holes 40. The top engagement holes 40 can be configured to receive a flat faced fastener 39. Accordingly, the flat face fasteners 39 can be used to secure the first half split flange 44 and the second half split flange 46 to the housing 26.

Each inner engagement hole 36 can receive a pointed fastener 38. Each pointed fastener 38 can have a pointed end 41. The pointed ends 41 can be engaged with the outer groove 57. In one or more embodiments, a spring loaded band or ring can be placed over the pointed fasteners, and the pointed fasteners can be sunk into the inner engagement holes 36. The spring loaded band can be configured to be selectively moved from a first position to a second position, and can be rotated about the housing 26 to tighten the all the pointed fasteners simultaneously. There can be one or more pointed fasteners.

In addition, the threaded extension 62 can engage the threaded hole 17 and the tapered bottom end 16 can engage the first half split flange 44 and the second half split flange 46 between the ball 54 and the conical skirt 58.

The tapered surface 50 can support the tapered bottom end 16. The first half split flange 44 and the second half split flange 46 can guide the ball 54 and allow the ball 54 to move freely there between.

Accordingly, the connection assembly 21 in FIG. 2 can be configured to maintain an angle of one hundred eighty degrees between the barrel 14 and handle 20 of FIG. 1 when a batter uses proper swing mechanics, and can be configured to allow an angle different than one hundred eighty degrees when the batter does not use proper swing mechanics.

While these embodiments have been described with emphasis on the embodiments, it should be understood that within the scope of the appended claims, the embodiments might be practiced other than as specifically described herein.

What is claimed is:

1. A training aid for a batter comprising:

a. a barrel having a top end opposite a tapered bottom end with a threaded hole centrally disposed in the tapered bottom end;

b. a handle having a first end and a second end;

c. a knob secured to the first end; and d. a connection assembly for connecting the barrel to the handle, wherein the connection assembly comprises:

(i) a housing secured to the second end opposite the knob, wherein the housing has a top surface through which is disposed an inner chamber disposed adjacent to a central fastening chamber, wherein the inner chamber has a plurality of inner engagement holes, wherein each inner engagement hole receives a pointed fastener with a pointed end, wherein the top surface has a plurality of top engagement holes, and wherein each top engagement hole receives a flat faced fastener;

(ii) a first half split flange with first half engagement holes and a second half split flange with second half engagement holes, wherein the first half split flange and the second half split flange form a tapered surface, and wherein the first half split flange and the second half split flange are positionable over the top surface for aligning the first half engagement holes and the second half engagement holes with the top engagement holes;

(iii) a pivoting connector comprising:

1. a ball with a pin hole centrally disposed in the ball and an outer groove disposed around a perimeter of the ball for accepting the pointed end of each pointed fastener;

2. a conical skirt, wherein a top portion of the conical skirt is connected to the ball opposite the pin hole; and 3. a threaded extension having an outer diameter less than an outer diameter of the conical skirt centrally extending from the conical skirt opposite the top portion, wherein the threaded extension engages the threaded hole, and wherein the first half split flange and the second half split flange allow the ball and the conical skirt to rotate freely there between; and (iv) a pin for slidingly engaging the pin hole and the central fastening chamber simultaneously, wherein the connection assembly is configured to maintain an angle of one hundred eighty degrees between the barrel and the handle when a batter uses proper swing mechanics, and wherein the connection assembly is configured to allow an angle different than one hundred eighty degrees between the barrel and the handle when the batter does not use proper swing mechanics.

2. The training aid for a batter of claim 1, wherein the central fastening chamber is threaded.

3. The training aid for a batter of claim 1, wherein the pivoting connector is made from steel or a reinforced metal.

4. The training aid for a batter of claim 1, wherein the barrel, the handle, the knob, the housing, and the tapered bottom end are made from a non-deforming lightweight polymer, an aluminum, or a graphite composite polymer.

5. A connection assembly for connecting a barrel to a handle, for maintaining an angle of one hundred eighty degrees between the barrel and the handle when proper swing mechanics are used, and for allowing an angle of different than one hundred eighty degrees between the barrel and the handle when proper swing mechanics are not used, the connection assembly comprising:

a. a housing secured to a second end of the handle opposite a knob of the handle, wherein the housing has a top surface through which is disposed an inner chamber disposed adjacent to a central fastening chamber, wherein the inner chamber has a plurality of inner engagement holes, wherein each inner engagement hole receives a pointed fastener with a pointed end, wherein the top surface has a plurality of top engagement holes, and wherein each top engagement hole receives a flat faced fastener;

b. a first half split flange with first half engagement holes and a second half split flange with second half engagement holes, wherein the first half split flange and the second half split flange form a tapered surface, and wherein the first half split flange and the second half split flange are positionable over the top surface for aligning the first half engagement holes and the second half engagement holes with the top engagement holes; and c. a pivoting connector comprising:

(i) a ball with a pin hole centrally disposed in the ball and an outer groove disposed around a perimeter of the ball for accepting the pointed end of each pointed fastener;

(ii) a conical skirt, wherein a top portion of the conical skirt is connected to the ball opposite the pin hole; and (iii) a threaded extension having an outer diameter less than an outer diameter of the conical skirt centrally extending from the conical skirt opposite the top portion, wherein the threaded extension engages the threaded hole, and wherein the first half split flange and the second half split flange allow the ball and the conical skirt to rotate freely there between.

6. The connection assembly of claim 5, wherein the central fastening chamber is threaded.

7. The connection assembly of claim 5, wherein the pivoting connector is made from steel or a reinforced metal.

8. The connection assembly of claim 5, further comprising an outer housing disposed about the connection assembly.

9. The connection assembly of claim 8, wherein the outer housing is a flexible material.

* * * * *